United States Patent [19]

Shekleton

[11] Patent Number: 5,069,033

[45] Date of Patent: Dec. 3, 1991

[54] RADIAL INFLOW COMBUSTOR

[75] Inventor: Jack R. Shekleton, San Diego, Calif.

[73] Assignee: Sundstrand Corporation, Rockford, Ill.

[21] Appl. No.: 455,559

[22] Filed: Dec. 21, 1989

[51] Int. Cl.[5] ..... F02C 7/00; F23R 3/16

[52] U.S. Cl. ..... 60/39.36; 60/737

[58] Field of Search ..... 60/39.36, 733, 737, 60/738, 751, 755, 756, 758, 760

[56] References Cited

U.S. PATENT DOCUMENTS

| | | | |
|---|---|---|---|
| 2,924,937 | 2/1960 | Leibach | 60/39.36 |
| 3,088,279 | 5/1963 | Diedrich | 60/39.36 |
| 3,285,006 | 11/1966 | Freeman et al. | 60/751 |
| 3,613,360 | 10/1971 | Howes | 60/39.36 |
| 3,869,864 | 3/1975 | Bunn | 60/758 |
| 3,927,520 | 12/1975 | Arvin et al. | |
| 4,242,863 | 1/1981 | Bailey | 60/738 |
| 4,339,925 | 7/1982 | Eggmann et al. | 60/758 |
| 4,343,147 | 8/1982 | Shekleton | 60/39.06 |
| 4,429,527 | 2/1984 | Teets | 60/737 |
| 4,545,196 | 10/1985 | Mozgia et al. | 60/733 |
| 4,549,402 | 10/1985 | Saintsbury et al. | 60/760 |
| 4,891,936 | 1/1990 | Shekleton et al. | 60/755 |
| 4,993,220 | 2/1991 | Shekleton et al. | 60/737 |

*Primary Examiner*—Louis J. Casaregola
*Assistant Examiner*—Timothy S. Thorpe
*Attorney, Agent, or Firm*—Wood, Phillips, Mason, Recktenwald & VanSanten

[57] ABSTRACT

In order to significantly reduce the carbon produced in a combustor, and thus reduce or eliminate carbon buildup on combustor walls, a gas turbine engine (10) has a radial compressor (12), an axial turbine (16), and a radial combustor (20). The radial combustor (20) includes a pair of axially spaced radially extending walls (62, 64) joined at radially outward extremes by a generally cylindrical wall (36). The walls (36, 62, 64) define a radial combustion space (24) in communication with both the radial compressor (12) and a turbine nozzle (22) and admit compressed air into the radial combustion space (24) in a manner avoiding formation of an air film on the generally cylindrical wall (36). The radial combustor (20) also includes a fuel injector (34) for injecting a liquid fuel into the radial combustion space (20) to impact the liquid fuel directly onto an inner surface (36*a*) of the generally cylindrical wall (36) to form a liquid fuel film (82) thereon. With this arrangement, the liquid fuel is centrifuged onto the inner surface (36*a*) of the generally cylindrical wall (36) to thereby produce a stabilized stratification within the radial combustion space in the form of the liquid fuel film (82), a gaseous fuel layer (80), a hot flame layer (84) and a cold air layer (86).

20 Claims, 3 Drawing Sheets

RADIAL INFLOW COMBUSTOR

FIELD OF THE INVENTION

This invention relates to gas turbine engines and, more particularly, to axial flow gas turbine engine combustors.

BACKGROUND OF THE INVENTION

In many applications, gas turbine engines are known to utilize reverse flow combustors for generating hot gases therein. In such combustors, the gases of combustion must reverse their direction of flow approximately 180 degrees before being applied to the turbine wheel. As a result, the "g" forces are generally perpendicular to the direction of flow within the combustor of the gas turbine engine.

By reason of the direction of the "g" forces, there is an undesirable interference with the aerodynamics of the air/fuel mixture. It would, thus, be desirable to avoid such aerodynamic interference by in some way avoiding an arrangement wherein the "g" forces are perpendicular to the direction of flow through the combustor. Still more specifically, it would be highly desirable to provide a combustor wherein the "g" forces are in the same direction as flow through the combustor.

However, while so doing, it must be kept in mind that the combustor must have a sufficient volume to achieve a satisfactory performance level. At the same time, there should not be any increase in engine envelope or overall weight. Still further, a reduction in the number of fuel injectors and the overall weight of the engine would be desirable to reduce cost.

In addition to the foregoing problems and considerations, there is another problem of considerable significance that requires attention in gas turbine engine combustor design. In combustors, a carbonaceous fuel is typically combusted with air to produce the hot gases of combustion but one difficulty in the operation and use of a combustor is carbon buildup which results when the fuel is not completely oxidized and elemental carbon is formed within the combustion chamber. If the combustor walls are not free of carbon buildup, carbon can break away and cause damage to downstream components as well as impair the efficiency of the combustor and gas turbine engine.

More specifically, gas turbine engine combustors are typically used to produce hot gases for driving turbine wheels. As carbon builds up, particles thereof typically break free and then flow with the hot gases of combustion through the turbine wheel where particulate carbon may erode the turbine nozzle and turbine wheel. Furthermore, carbon deposits can build up on the surface of the turbine nozzle and restrict flow to causes performance losses.

Still another problem associated with excessive carbon production is the existence of a massive black exhaust plume which is highly undesirable.

Presently, it is believed that a substantial portion of the carbon produced is a result of liquid phase pyrolysis during liquid fuel droplet evaporation. Some gas phase carbon probably also results from the cracking reactions. However, gas phase carbon is on the molecular level and much less harmful than liquid phase carbon which is on the order of microns for purposes of comparison.

Since it is believed that the carbon is a result of liquid phase pyrolysis, it is essential to achieve rapid fuel evaporation. This is believed to be the best known manner of minimizing liquid phase carbon. However, combustors have not been entirely satisfactory in addressing these serious carbon problems.

The present invention is directed to overcoming one or more of the foregoing problems and achieving one or more of the resulting objects.

SUMMARY OF THE INVENTION

It is the principal object of the invention to provide a new and improved gas turbine engine and combustor characterized by enhanced efficiency and operational reliability. More specifically, it is an object of the invention to provide a new and improved axial flow gas turbine engine having a radial combustor with a generally radial flow path therethrough whereby an interior wall fuel film is evaporated by interaction with hot gases of combustion. It is also an object of the invention to provide a combustor in which the hot gases of combustion interact with a cold liquid fuel film to thereby produce a cool gaseous fuel annulus in a stabilized stratification.

An exemplary embodiment of the invention achieves the foregoing objects in a gas turbine engine having radial compressor means for compressing air entering through a compressor inlet opening for delivery to radial combustor means. The engine also includes axial turbine means in axially spaced relation to the radial compressor means with the radial combustor means being positioned intermediate the two and wherein the radial compressor means is operatively associated with the axial turbine means for driven movement thereby. Still further, the engine includes turbine nozzle means for directing gases of combustion to the axial turbine means and fuel injection means operatively associated with the radial combustor means radially outwardly of the turbine nozzle means.

In accordance with the invention, the radial combustor means includes a pair of axially spaced radially extending walls joined at radially outward extremes by a generally cylindrical wall. The walls define an annular combustion chamber having a radial combustion space within the radial combustor means which is in communication with both the radial compressor means and the turbine nozzle means, and the engine also includes means for introducing compressed air into the radial combustion space in a manner avoiding formation of an air film on the generally cylindrical wall. Additionally, the fuel injection means is such as to inject a liquid fuel into the radial combustion space to impact the liquid fuel directly onto an inner surface of the generally cylindrical wall to form a liquid fuel film thereon.

In a preferred embodiment, the gas turbine engine includes means for igniting a mixture of fuel and air within the radial combustion space to generate the gases of combustion. The fuel injection means may also include a plurality of fuel injectors mounted in circumferentially spaced relation in the generally cylindrical wall so as to be disposed either in a common plane extending generally perpendicular to an axis of the radial combustor means or in one of two axially spaced planes extending generally perpendicular to the axis of the radial combustor means. In one embodiment, the fuel injection means includes a fuel manifold communicating with a plurality of open elongated tubes in the generally cylindrical wall for directing the fuel generally tangentially into the radial combustor means.

Preferably, a compressed air inlet is in communication with a compressed air outlet of the radial compressor means to direct compressed air into the radial combustion space for combustion with the fuel to generate the gases of combustion. The compressed air inlet may, for instance, be integral with each of the fuel injectors and may also include means for introducing dilution air into the radial combustion space upstream of the turbine nozzle means to cool the gases of combustion. Advantageously, the radially extending walls define a necked down region at a radially inward position closely adjacent the turbine nozzle means and a plurality of rows of dilution air inlets extend circumferentially about the radially extending walls from a point near the generally cylindrical wall radially inward toward the necked down region.

In a highly preferred embodiment, the compressed air is introduced into the radial combustion space so as to cause liquid fuel to be centrifuged onto the inner surface of the generally cylindrical wall. In this manner, a stabilized stratification is produced within the radial combustion space. Preferably, this stratification comprises a gaseous fuel layer radially inward of the cold liquid fuel film, a hot flame layer radially inward of the gases fuel layer, and a cold air layer radially inward of the hot flame layer.

Other objects, advantages and features of the present invention will become apparent from a consideration of the following specification taken in conjunction with the accompanying drawings.

DETAILED DESCRIPTION OF THE PREFERRED EMBODIMENTS

An exemplary embodiment of a gas turbine engine of the axial flow type having a radial combustor in accordance with the invention has been illustrated. It will be appreciated that, by way of example, the gas turbine engine could be of the split or fixed shaft type. However, the invention is not limited to any particular type of turbine but may have applicability to any form of gas turbine engine.

Figure 1:
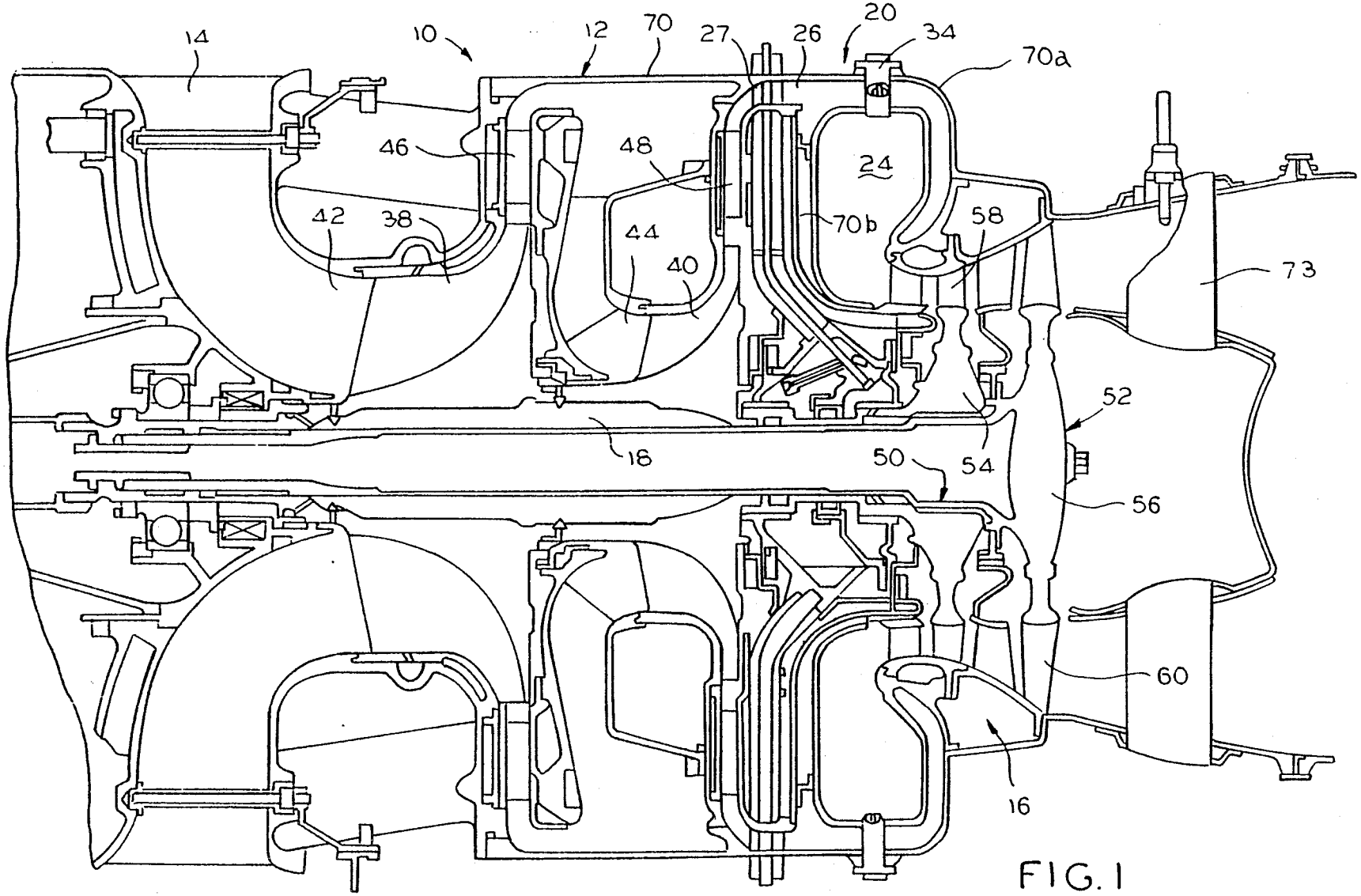
FIG. 1 is a cross sectional view of a gas turbine engine in accordance with the present invention.

Referring to FIG. 1, the reference numeral 10 designates generally a gas turbine engine in accordance with the present invention. It will be appreciated that the gas turbine engine 10 illustrated is of the axial flow type and includes a radial compressor generally designated 12 for compressing air entering through a compressor inlet opening 14 and an axial turbine generally designated 16 operatively associated with the radial compressor 12 for driven movement of the compressor through a common shaft 18. Also as shown, the gas turbine engine 10 includes a radial combustor generally designated 20 which is disposed intermediate the radial compressor 12 and axial turbine 16.

Figure 2:
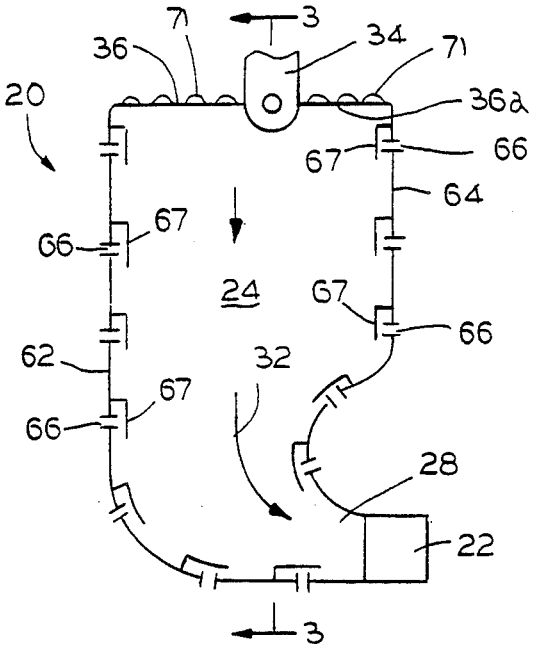
FIG. 2 is an enlarged cross sectional view of a radial combustor as illustrated in FIG. 1.

Referring to both of FIGS. 1 and 2, a turbine nozzle 22 is provided proximate the axial turbine 16 for directing gases of combustion thereto. The radial combustor 20 comprises an annular combustion chamber defining a radial combustion space 24 where the gases of combustion are generated by combusting fuel from a conventional source (not shown) and air from the radial compressor 12. For this reason, the radial combustion space 24 is in communication with the radial compressor 12 as through passageway 26 which may typically include deswirl vanes as at 27 to ensure axial flow toward the radial combustor 20 and ultimately to the radial combustion space 24, and it will also be appreciated that the radial combustion space 24 is in communication with the turbine nozzle 22 as at the necked down portion 28 of the radial combustor 20. The gases of combustion generated in the radial combustion space 24 can therefore be directed through the turbine nozzle 22 to the axial turbine 16. With this arrangement, the radial combustor 20 is provided with an inlet 30 to admit compressed air flowing through the passageway 26 into the radial combustion space 24.

As will be described hereinafter, the compressed air inlet 30 is preferably adapted to admit a mixture of compressed air and fuel into the radial combustion space 24 where the mixture is combusted to generate the hot gases of combustion. These gases are then directed through the turbine nozzle 22 for driving the axial turbine 16. As shown, the turbine nozzle 22 is disposed radially inwardly of the radial combustion space 24 to define a generally radial flow path for the fuel/air mixture and the hot gases of combustion as generally represented by the arrow 32.

Figure 3:
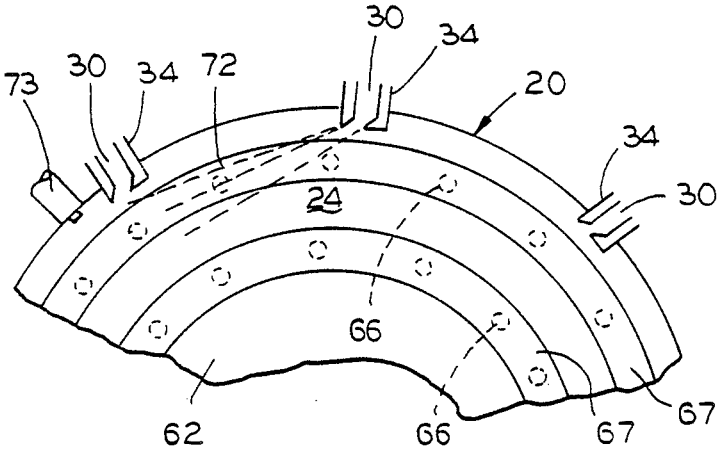
FIG. 3 is a cross sectional view taken on the line 3—3 of FIG. 2.

Referring to FIGS. 1 through 3, the gas turbine engine 10 advantageously includes fuel injection means in the form of a fuel injector 34 associated with the radial combustor 20 radially outwardly of the turbine nozzle 22 for not only admitting fuel but also defining what has previously been described as the compressed air inlet 30. Preferably, a plurality of such fuel injectors 34 are mounted in circumferentially spaced relation in a generally cylindrical wall 36 of the radial combustor 20 so as to be in a common plane extending generally perpendicular to an axis of the radial combustor 20 defined by the shaft 18. Alternatively, and referring to FIG. 4, the fuel injectors 34 may be disposed in two axially spaced planes in the generally cylindrical wall 36 which is a particularly advantageous technique for improving high altitude ignition and/or reducing combustor size.

As shown, the radial compressor 12 preferably includes a first radial inflow compressor stage 38 and a second radial inflow compressor stage 40. The compressor inlet opening 14 is in communication with a compressed air inlet 42 of the first radial inflow compressor stage 38 to supply air thereto whereas the second radial inflow compressor stage 40 has a compressed air inlet 44 for receiving compressed air from a compressed air outlet 46 of the first radial inflow compressor stage 38. Additionally, the radial compressor 12 is formed such that the second radial inflow compressor stage 40 has a compressed air outlet 48.

With this arrangement, the fuel injectors 34 are such that the compressed air inlets 30 are in communication with the compressed air outlet 48 of the second radial inflow compressor stage 40. More specifically, the compressed air inlets 30 of the fuel injectors 34 communicate directly with the passageway 26 to receive compressed air from the second radial inflow compressor stage 40. In addition, the fuel injectors 34 are such that fuel from the source is delivered for mixing with the compressed air in the compressed air inlets 30 so the fuel/air mixture can be combusted in the radial combustion space 24.

Still referring to FIG. 1, the axial turbine 16 includes a first axial turbine stage generally designated 50 and a second axial turbine stage generally designated 52. It will be seen that the first axial turbine stage 50 is in communication with the radial combustion space 24 through the turbine nozzle 22 for receiving the gases of combustion from the radial combustion space 24 for driven movement of the first axial turbine stage 50. It will also be seen that the second axial turbine stage 52 is in communication with the first axial turbine stage 50 for receiving the gases of combustion from the radial combustion space 24 downstream of the first axial turbine stage 50 for driven movement of the second axial turbine stage 52. As shown, the first and second axial turbine stages 50 and 52 each include a turbine wheel 54 and 56, respectively, each of which has rotor blades 58 and 60, respectively.

With the embodiment as illustrated in FIG. 1, the turbine wheels 54 and 56 are each disposed on the common shaft 18 along with the radial compressor 12. Thus, since the turbine wheels 54 and 56 and the radial compressor 12 are mounted so as to be integral with the shaft 18, as the hot gases of combustion drive the turbine wheels 54 and 56, the radial compressor 12, including both the first and second radial inflow stages 38 and 40, is in coaxial spaced relation to the turbine wheels 54 and 56 but is also driven through the shaft 18. In other words, the radial compressor 12 is driven by the axial flow of the gases of combustion through the rotor blades 58 and 60.

Referring once again to both of FIGS. 1 and 2, the radial combustor 20 includes a pair of axially spaced radially extending walls 62 and 64 joined at radially outward extremes by the generally cylindrical wall 36 where the fuel injectors 34 are mounted for injecting a mixture of fuel from the source with air from the radial compressor 12 in a generally tangential direction into the radial combustion space 24. The radially extending walls 62 and 64 define the necked down region 28 at radially inward extremes adjacent the turbine nozzle 22. In addition, as shown in FIG. 3, the gas turbine engine 10 includes means for introducing dilution air into the radial combustion space 24 tangentially of the radially extending walls 62 and 64 in the form of a plurality of circumferentially disposed dilution air inlets 66 opposite each of the circumferential cooling strips 67 on the radially extending walls 62 and 64 for cooling the walls 62 and 64 as well as the gases of combustion before they are directed to the axial turbine 16.

As previously mentioned, deswirl vanes 27 may commonly be employed to deswirl air from the radial compressor 12 to provide axial flow in the passageway 26. However, it should be appreciated that the air flow injection into the radial combustor 20 is primarily tangential as through the compressed air inlets 30 of the fuel injectors 34 and tangential relative to the radially extending walls 62 and 64 through the dilution air inlets 66 opposite each of the cooling strips 67. Hence, the radial combustor 20 is tolerant of inlet swirl flow, and in fact may have high inlet swirl, making it possible to entirely eliminate deswirl vanes.

As shown in FIGS. 1 and 2, the radial combustor 20 is generally in the form of an annular combustion chamber which incorporates the radial combustion space 24 in a radially expanded and axially shortened combustor configuration. That is to say that the radially extending wall 62 is greater in length than the generally cylindrical wall 36. In this manner, the gas turbine engine 10 takes full radial advantage of the existing engine envelope while minimizing the axial length to thereby also provide a relatively significant reduction in size and weight.

As shown in FIG. 1, the gas turbine engine 10 includes a housing generally designated 70 which defines a combustor housing **70*a*. The combustor housing 70*a* is in the region of the radial combustor 20, and it is spaced from and substantially entirely surrounds the generally cylindrical wall 36 and radially extending wall 64. Further, an interior combustor housing wall 70*b* is provided in spaced relation to the radially extending wall 62**.

With this arrangement, a dilution air flow path is defined which is in communication with the radial compressor 12 for receiving compressed air therefrom. This compressed air then flows between the housing wall **70*a* on the one hand and the generally cylindrical wall 36 and radially extending wall 64 on the other as well as between the housing wall 70*b* on the one hand and the radially extending wall 62 on the other. In other words, the dilution air flow path leads over all of the generally cylindrical and radially extending walls 36, 62 and 64 externally of the radial combustor 20 and into the radial combustor 20 through the dilution air inlets 66** as previously described.

As will be appreciated, the radial combustor 20 has both external convective cooling and air film cooling on the inner surfaces **62*a* and 64*a* of the radially extending walls 62 and 64, respectively. The generally cylindrical wall 36 is cooled by external convective cooling which may be assisted by utilizing trip strips 71 (see FIGS. 2 and 4) as well as the presence of a cold liquid fuel film on the interior surface 36*a* of the wall 36 in conjunction with a blue, low radiation flame which will be described hereinafter. As for the air films on the inner surfaces 62*a* and 64*a* of the radially extending walls 62 and 64, they are generally in neutral equilibrium, i.e., there are no large "g" force effects to destabilize the air films which renders them particularly efficient in cooling the walls 62 and 64**.

By referring to FIG. 3, it will be appreciated that the fuel injectors 34 inject fuel and compressed air generally tangentially along a path such as 72 into the radial combustion space 24. More specifically, the fuel is preferably a liquid fuel which is injected into the radial combustion space 24 to impact the liquid fuel directly onto an inner surface **36*a* of the generally cylindrical wall 36 to form a cold liquid fuel film thereon. Also, and as will be appreciated by referring to FIG. 3, a conventional igniter or igniters 73 will be mounted in the radial combustor 20** to cause the combustion of the fuel/air mixture.

Referring once again to FIG. 1, the outer housing 70 substantially entirely encloses the radial compressor 12, axial turbine 16 and radial combustor 20. Further, the generally cylindrical wall 36 and radially extending wall 64 are disposed in spaced generally parallel relation to the outer housing wall **70*a* whereas the radially extending wall 62 is disposed in spaced generally parallel relation to the inner housing wall 70***b*. In this manner, compressed air readily flows from the radial compressor 12 through the passageway 26 to the dilution air inlets 66 and to the compressed air inlets 30 in the fuel injectors 34.

Figure 4:
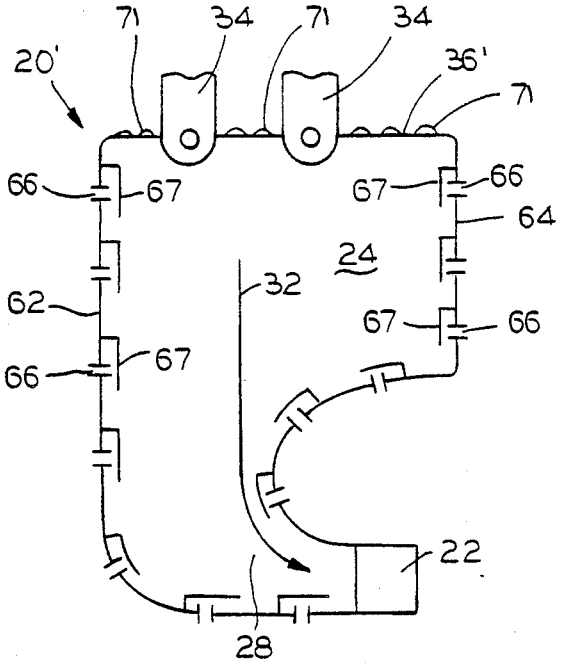
FIG. 4 is a cross sectional view of an alternative radial combustor of the type illustrated in FIG. 1.

As will be appreciated by referring to any of FIGS. 1, 2 and 4, the gases of combustion will follow the generally radial flow path 32 spiralling radially inwardly to the necked down region 28 of the radial combustor 20. When the gases of combustion reach the necked down region 28, they are diverted to a generally axial flow path leading to the turbine nozzle 22 and then axially to the axial turbine 16, i.e., to the blades 58 and 60 of the first and second axial turbine stages 50 and 52, respectively. After the gases of combustion pass through the first and second axial turbine stages 50 and 52, they exit the gas turbine engine 10 through an exhaust duct 73.

Comparing FIGS. 2 and 4, it will be noted that the two radial combustor configurations 20 and 20' differ in one significant respect. More specifically, the length of the generally cylindrical wall 36' in FIG. 4 is greater than the length of the corresponding generally cylindrical wall 36 in FIG. 2 so as to accommodate two rows of fuel injectors 34, i.e., two rows of circumferentially spaced fuel injectors 34 disposed in two spaced planes both of which are perpendicular to the axially extending shaft 18. However, the radially extending walls 62 and 64 will be identical in radial length in both embodiments.

Figure 3A:
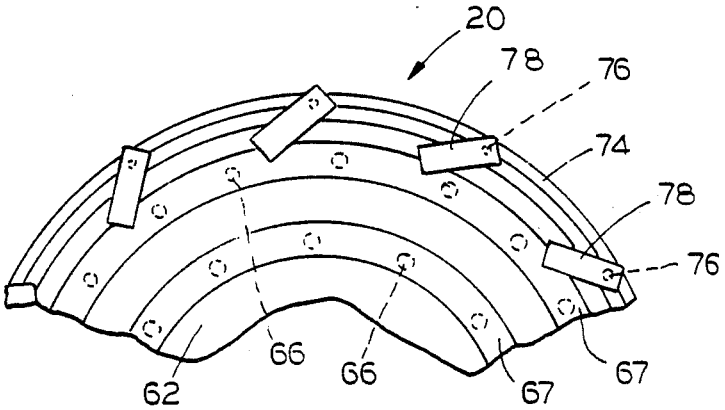
FIG. 3A is a view similar to FIG. 3 illustrating an alternative embodiment.

Referring to FIG. 3A, the fuel injection means may take the form of a fuel manifold 74 which may be supplied with fuel from a source (not shown), and the fuel manifold 74 will have a plurality of circumferentially spaced fuel dispensing openings 76. In addition, the fuel injection means will also take the form of a plurality of open elongated tubes 78 in the generally cylindrical wall 36 adjacent the fuel manifold 74 for directing the fuel generally tangentially into the radial combustor 20.

Figure 7:
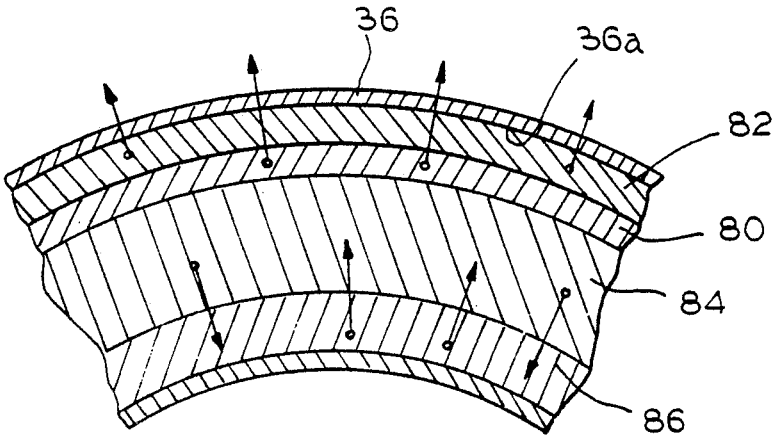
FIG. 7 is a schematic cross sectional view illustrating stratification within the annular combustion chamber in accordance with the present invention.

Referring to FIG. 7, compressed air introduced into the radial combustion space 24 causes cold liquid fuel to be centrifuged onto the inner surface 36*a* of the generally cylindrical wall 36 which, in turn, produces a unique stabilized stratification within the radial combustion space 24. More specifically, the stabilized stratification takes the form of a gaseous fuel layer 80 radially inward of the liquid fuel film 82, a hot flame layer 84 radially inward of the gaseous fuel layer 80, and a cold air layer 86 radially inward of the hot flame layer 84.

As will now be appreciated, there is no dilution air introduced in a manner which would cause an air film on the inner surface 36*a* of the generally cylindrical wall 36. Instead, only combustion air is introduced and then through either the fuel injectors 34 or the tubes 78 which merely assists in forming the cold liquid fuel film 82 on the inner surface 36*a* of the generally cylindrical wall 36. As for the radially extending walls 62 and 64, they do have an air film produced by the plurality of rows of dilution air inlets 66 leading from a point near the generally cylindrical wall 36 radially inward toward the necked down region 28.

Figure 6:
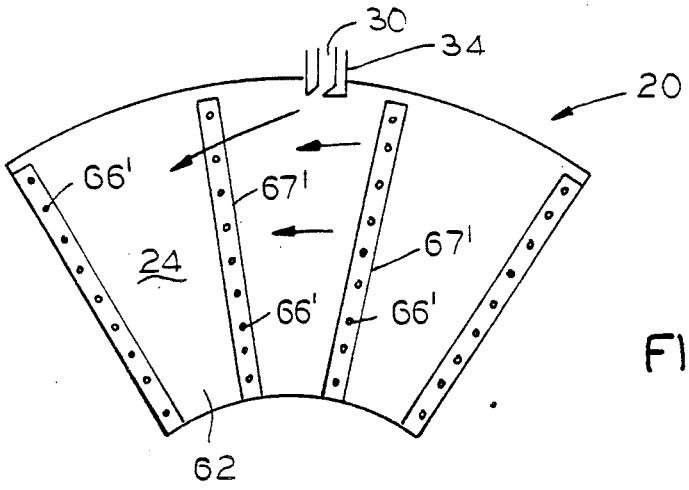
FIG. 6 is a cross sectional view taken on the line 6—6 of FIG. 5.
Figure 5:
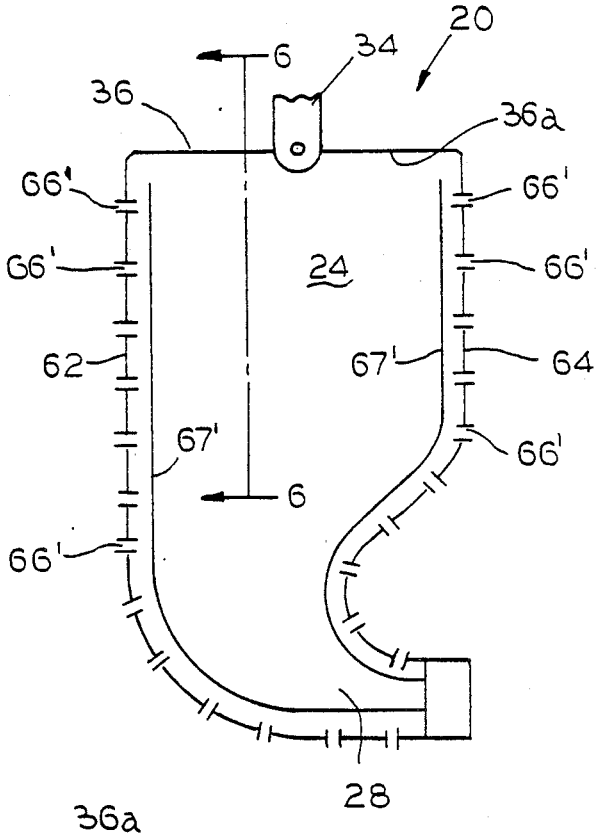
FIG. 5 is an enlarged cross sectional view of an alternative embodiment of a radial combustor.

Referring to FIGS. 5 and 6, the gas turbine engine 10 may include alternative means for introducing dilution air into the radial combustion space 24 tangentially of the radially extending walls 62 and 64. This may take the form of a plurality of radially disposed dilution air inlets 66' opposite each of the circumferential cooling strips 67' for cooling the radially extending walls 62 and 64 as well as the gases of combustion before they are directed to the axial turbine 16. However, as before, there will be no dilution air introduced in a manner which would cause an air film on the inner surface 36*a* of the generally cylindrical wall 36. Instead, only combustion air is introduced and then through either the fuel injectors 34 or the tubes 78 which merely assists in forming the cold liquid fuel film 82 on the inner surface 36*a* of the generally cylindrical wall 36. As for the radially extending walls 62 and 64, they do have an air film produced by the plurality of rows of dilution air inlets 66' leading from a point near the generally cylindrical wall 36 radially inward toward the necked down region 28.

With the present invention, fuel evaporation is accelerated by means of the unique stratification previously discussed. Thus, the carbon/smoke problems are overcome. In addition, this is all achieved while utilizing an inexpensive fuel injection technique even with difficult to burn JP10 fuel.

In this connection, the high tangential swirl of the combustion air creates very high "g" forces on the fuel droplets that are injected through the injectors 34 or tubes 78. This causes the fuel droplets to be centrifuged onto the inside surface 36*a* of the generally cylindrical wall 36 while small fuel droplets are rapidly evaporated and form the nucleus of a blue flame. As for the large fuel droplets, they spread out as the thin cold liquid fuel film 82 as they impact the generally cylindrical wall 36.

As a thin cold liquid fuel film 82, evaporation is greatly accelerated. This occurs because there is always a higher relative velocity between the slow moving liquid fuel film 82 and the radially inwardly located hot, fast initial flame 84. For this reason, very fast, smokeless, carbon-free fuel evaporation is achieved.

In addition to accelerating evaporation, fuel/air mixing is also accelerated since the heavy cold liquid fuel film 82 constrained by "g" forces necessarily is on the generally cylindrical wall 36 and the somewhat less heavy evaporated gaseous fuel layer 80 lies adjacent to the cold liquid fuel film 82. In addition, the much less heavy hot flame layer 84 moves radially inward under "g" force effects while the heavier cold air layer 86 moves radially outward under "g" force effects With this interaction between the stratified layers 80, 82, 84 and 86, ignition of a fuel and air mixture is achieved which causes the combusted fuel/air mixture to move radially inward following which the whole cycle continuously repeats until all fuel is burned.

Hence, by use of high "g" forces it has been possible to accelerate mixing. This is particularly advantageous in applications involving axially limited space where reverse flow combustors are not well suited In addition, it has been possible to accelerate evaporation.

The result is a smokeless and efficient, short and stable blue flame, and it is thus possible to operate the combustor without carbon buildup and totally free of exhaust smoke in an extremely small volume. Moreover, as will be appreciated from the foregoing, the combustor is a simple, inexpensive and lightweight configuration capable of burning even difficult to burn fuels such as JP10.

With the present invention, the low radiation of the blue flame has numerous advantages including the fact that it is possible to operate the combustor while keeping the radially extending walls 62 and 64 cool by use of dilution air. Likewise, it will be appreciated from the foregoing that the absence of a film of air on the generally cylindrical wall 36 is vital in order to be able to achieve the objectives of accelerated fuel evaporation and fast flame propagation mentioned hereinabove.

If a film of air is present on the generally cylindrical wall 36, this will significantly slow evaporation and impede ignition. The fuel then slowly evaporates and forms carbon. In many applications, the film of air may serve as a means of flame quench and will most definitely take up combustor volume.

For purposes of further understanding the structure and operation of the combustor, the teachings of commonly owned copending patent application U.S. Ser. No. 384,164, filed July 24, 1989, and titled "Axial Flow Gas Turbine Engine Combustor" are hereby incorporated by reference. From the teachings therein, it will be understood how fuel evaporation is automatically enhanced in small combustors in a most effective manner, and the technique of achieving higher combustion efficiency will also be fully understood.

While in the foregoing there have been set forth preferred embodiments of the invention, it will be appreciated that the invention is only to be limited by the true spirit and scope of the appended claims.

I claim:

1. A gas turbine engine, comprising:

radial compressor means for compressing air entering through a compressor inlet opening;

axial turbine means in axially spaced relation to said radial compressor means;

said radial compressor means being operatively associated with said axial turbine means;

radial combustor means intermediate said radial compressor means and axial turbine means;

turbine nozzle means proximate said axial turbine means for directing gases of combustion thereto;

said radial combustor means including a pair of axially spaced radially extending walls joined at radially outward extremes by a generally cylindrical wall, said walls defining a radial combustion space in communication with both said radial compressor means and said turbine nozzle means, and including means for introducing compressed air into said radial combustion space in a manner avoiding formation of an air film on said generally cylindrical wall;

means for injecting a liquid fuel into said radial combustion space so as to impact said liquid fuel directly onto an inner surface of said generally cylindrical wall to form a liquid fuel film thereon; and means for igniting a mixture of fuel and air within said radial combustion space to generate said gases of combustion.

2. The gas turbine engine of claim 1 wherein said fuel injection means includes a plurality of fuel injectors mounted in circumferentially spaced relation in said generally cylindrical wall, said circumferentially spaced fuel injectors being disposed in a common plane extending generally perpendicular to an axis of said radial combustor means.

3. The gas turbine engine of claim 1 wherein said fuel injection means includes a plurality of fuel injectors mounted in circumferentially and axially spaced relation in said generally cylindrical wall, said circumferentially and axially spaced fuel injectors each being disposed in one of two axially spaced planes extending generally perpendicular to an axis of said radial combustor means.

4. The gas turbine engine of claim 1 wherein said fuel injection means includes a fuel manifold having a plurality of circumferentially spaced fuel dispensing openings, said fuel injection means also including a plurality of open elongated tubes in said generally cylindrical wall adjacent said fuel manifold for directing said fuel generally tangentially into said radial combustor means.

5. The gas turbine engine of claim 1 wherein said means for introducing compressed air includes a compressed air inlet in communication with a compressed air outlet of said radial compressor means to direct compressed air from said compressed air outlet of said radial compressor means into said radial combustion space for combustion with said fuel to generate said gases of combustion.

6. The gas turbine engine of claim 1 wherein said means for introducing compressed air into said radial combustion space includes a compressed air inlet integral with each of said fuel injection means and including means for introducing dilution air into said radial combustion space upstream of said turbine nozzle means to cool said gases of combustion.

7. The gas turbine engine of claim 1 wherein said means for introducing compressed air into said radial combustion space causes liquid fuel to be centrifuged onto said inner surface of said generally cylindrical wall to thereby produce a stabilized stratification within said radial combustion space in the form of a gaseous fuel layer radially inward of said liquid fuel film, a hot flame layer radially inward of said gaseous fuel layer, and a cold air layer radially inward of said hot flame layer.

8. The gas turbine engine of claim 1 wherein said radially extending walls define a necked down region at a radially inward position closely adjacent said turbine nozzle means, said radial combustor means including a plurality of circumferential rows of dilution air inlets in said radially extending walls leading from a point near said generally cylindrical wall radially inward toward said necked down region.

9. A gas turbine engine, comprising:

radial compressor means for compressing air entering through a compressor inlet opening;

axial turbine means in axially spaced relation to said radial compressor means;

said radial compressor means being operatively associated with said axial turbine means;

radial combustor means intermediate said radial compressor means and axial turbine means;

turbine nozzle means proximate said axial turbine means for directing gases of combustion thereto said radial combustor means including a pair of axially spaced radially extending walls joined at radially outward extremes by a generally cylindrical wall, said walls defining a radial combustion space in communication with both said radial compressor means and said turbine nozzle means, and including means for introducing compressed air into said radial combustion space in a manner avoiding formation of an air film on said generally cylindrical wall;

means for injecting a liquid fuel into said radial combustion space so as to impact said liquid fuel directly onto an inner surface of said generally cylindrical wall to form a liquid fuel film thereon;

said fuel injection means including a plurality of fuel injectors mounted in circumferentially spaced relation in said generally cylindrical wall, said circumferentially spaced fuel injectors being disposed in a common plane extending generally perpendicular to an axis of said radial combustor means; and means for igniting a mixture of fuel and air within said radial combustion space to generate said gases of combustion;

said means for introducing compressed air into said radial combustion space causing liquid fuel to be centrifuged onto said inner surface of said generally cylindrical wall to thereby produce a stabilized stratification within said radial combustion space in the form of a gaseous fuel layer radially inward of said liquid fuel film, a hot flame layer radially inward of said gaseous fuel layer, and a cold air layer radially inward of said hot flame layer.

10. The gas turbine engine of claim 9 wherein said fuel injectors are mounted in circumferentially and axially spaced relation in said generally cylindrical wall of said radial combustor means, said circumferentially and axially spaced fuel injectors each being disposed in one of two axially spaced planes extending generally perpendicular to an axis of said radial combustor means.

11. The gas turbine engine of claim 9 wherein said fuel injectors comprise a fuel manifold having a plurality of circumferentially spaced fuel dispensing openings together with a plurality of open elongated tubes in said generally cylindrical wall of said radial combustor means adjacent said fuel manifold for directing said fuel generally tangentially into said radial combustor means.

12. The gas turbine engine of claim 9 wherein said means for introducing compressed air includes compressed air inlet means in communication with a compressed air outlet of said radial compressor means to direct compressed air from said compressed air outlet into said radial combustion space for combustion with said fuel to generate said gases of combustion.

13. The gas turbine engine of claim 12 wherein said compressed air inlet means comprises a compressed air inlet integral with each of said fuel injectors and including means for introducing dilution air into said radial combustion space solely through said radially extending wall upstream of said turbine nozzle means to cool said gases of combustion.

14. The gas turbine engine of claim 13 wherein said radially extending walls define a necked down region at a radially inward position closely adjacent said turbine nozzle means, said radial combustor means including a plurality of circumferential rows of dilution air inlets in said radially extending walls leading from a point near said generally cylindrical wall radially inward toward said necked down region.

15. A gas turbine engine, comprising:

radial compressor means for compressing air entering through a compressor inlet opening;

axial turbine means in axially spaced relation to said radial compressor means;

said radial compressor means and said axial turbine means being integral with an axially extending shaft, said axial turbine means being adapted to drive said radial compressor means through said axially extending shaft;

radial combustor means intermediate said radial compressor means and axial turbine means;

turbine nozzle means proximate said axial turbine means for directing gases of combustion thereto;

said radial combustor means including a pair of axially spaced radially extending walls joined at radially outward extremes by an axially extending generally cylindrical wall, said walls defining an annular combustion chamber having a radial combustion space in communication with both said radial compressor means and said turbine nozzle means, and including means for introducing compressed air into said annular combustion chamber in a manner avoiding formation of an air film on said generally cylindrical wall;

means for injecting a liquid fuel into said annular combustion chamber so as to impact said liquid fuel directly onto an inner surface of said generally cylindrical wall to form a liquid fuel film thereon;

said fuel injection means including a plurality of fuel injectors mounted in circumferentially spaced relation in said generally cylindrical wall, said circumferentially spaced fuel injectors being disposed in a common plane extending generally perpendicular to an axis of said radial combustor means;

an outer housing substantially entirely enclosing said radial compressor means, axial turbine means and radial combustor means, said generally cylindrical wall and one of said radially extending walls of said radial combustor means being disposed in spaced relation to said outer housing and including a further inner housing in spaced parallel relation to the other of said radially extending walls of said radial combustor means, said housings and said walls defining a convective cooling dilution air flow path in communication with said radial compressor means for receiving compressed air therefrom; and means for igniting a mixture of fuel and air within said radial combustion space to generate said gases of combustion;

said means for introducing compressed air into said radial combustion space causing said liquid fuel to be centrifuged onto said inner surface of said generally cylindrical wall to thereby produce a stabilized stratification within said radial combustion space in the form of a gaseous fuel layer radially inward of said liquid fuel film, a hot flame layer radially inward of said gaseous fuel layer, and a cold air layer radially inward of said hot flame layer;

only said radially extending walls having dilution air inlets leading to said annular combustion chamber.

16. The gas turbine engine of claim 15 wherein said radially extending walls define a necked down region at radially inward extremes adjacent said turbine nozzle means, said dilution air inlets being circumferentially positioned so as to introduce dilution air into said radial combustion space upstream of said turbine nozzle means to cool said gases of combustion and said radially extending walls.

17. The gas turbine engine of claim 16 wherein said gases of combustion follow a generally radial flow path radially inwardly to said necked down region, said gases of combustion being diverted at said necked down region to a generally axial flow path leading to said turbine nozzle means and then to said axial turbine means.

18. The gas turbine engine of claim 1 wherein said means for introducing compressed air includes compressed air inlet means in communication with a compressed air outlet of said radial compressor means to direct compressed air from said compressed air outlet into said radial combustion space for combustion with said fuel to generate said gases of combustion.

19. The gas turbine engine of claim 18 wherein said compressed air inlet means comprises a compressed air inlet integral with each of said fuel injectors and including means for introducing dilution air into said radial combustion space solely through said radially extending wall upstream of said turbine nozzle means to cool said gases of combustion and said radially extending walls.

20. The gas turbine engine of claim 15 wherein said fuel injectors are mounted in circumferentially and axially spaced relation in said generally cylindrical wall of said radial combustor means, said circumferentially and axially spaced fuel injectors each being disposed in one of two axially spaced planes extending generally perpendicular to an axis of said radial combustor means.

* * * * *